US005456157A

United States Patent [19]

Lougheed et al.

[11] Patent Number: 5,456,157

[45] Date of Patent: Oct. 10, 1995

[54] WEAPON AIMING SYSTEM

[75] Inventors: James H. Lougheed, Kinburn; Mark Wardell, Nepean; Daniel R. Sheney, Vernon, all of Canada

[73] Assignee: Computing Devices Canada Ltd., Ottawa, Canada

[21] Appl. No.: 984,692

[22] Filed: Dec. 2, 1992

[51] Int. Cl.[6] ..... F41A 17/08

[52] U.S. Cl. ..... 89/134; 348/143; 348/155; 364/423

[58] Field of Search ..... 42/103; 89/41.05, 89/41.18, 134; 358/108; 364/423; 348/143, 155, 158, 169

[56] References Cited

U.S. PATENT DOCUMENTS

| | | | |
|---|---|---|---|
| 3,575,085 | 4/1971 | McAdam | 89/41.06 |
| 3,757,632 | 9/1973 | Bellinger | 89/1.1 |
| 3,798,795 | 3/1974 | Michelsen | 35/25 |
| 3,953,132 | 4/1976 | Michelsen | 356/152 |
| 3,997,762 | 12/1976 | Ritchie et al. | 235/404 |
| 4,015,258 | 3/1977 | Smith et al. | 342/54 |
| 4,094,225 | 6/1978 | Greenwood | 89/41.06 |
| 4,202,246 | 5/1980 | Schertz et al. | 89/41.21 |
| 4,316,218 | 2/1982 | Gay | 358/125 |
| 4,318,330 | 3/1982 | Hausenblas | 89/41.05 |
| 4,370,914 | 2/1983 | Voles | 89/41.05 |
| 4,386,848 | 6/1983 | Clendenin et al. | 356/5 |
| 4,418,361 | 11/1983 | Bagnall-Wild et al. | 358/125 |
| 4,470,817 | 9/1984 | Diehl et al. | 434/22 |
| 4,518,990 | 5/1985 | Gilvydis | 358/87 |
| 4,570,530 | 2/1986 | Armstrong | 89/41.05 |
| 4,606,256 | 8/1986 | De'Ath | 89/41.09 |
| 4,665,795 | 5/1987 | Carbonneau et al. | 89/41.03 |
| 4,739,401 | 4/1988 | Sacks et al. | 358/126 |
| 4,760,770 | 8/1988 | Bagnall-Wild et al. | 364/423 |
| 4,780,719 | 10/1988 | Frei et al. | 342/53 |
| 4,787,291 | 11/1988 | Frohock, Jr. | 89/41.22 |
| 4,843,459 | 6/1989 | Perrin et al. | 358/93 |
| 4,885,977 | 12/1989 | Kirson et al. | 89/41.05 |
| 4,908,704 | 3/1990 | Fujioka et al. | 358/108 |
| 4,922,801 | 5/1990 | Jaquard et al. | 89/41.05 |
| 4,936,190 | 6/1990 | Pilcher, II | 89/41.05 |
| 5,099,322 | 3/1992 | Gove | 358/105 |
| 5,099,324 | 3/1992 | Abe | 558/108 |
| 5,208,418 | 5/1993 | Toth et al. | 89/41.05 |

FOREIGN PATENT DOCUMENTS

| | | | |
|---|---|---|---|
| 1591422 | 6/1981 | United Kingdom | 89/134 |

OTHER PUBLICATIONS

Elements of Naval Gunnery, 1945, pp. 111–113.

*Primary Examiner*—Stephen C. Bentley
*Attorney, Agent, or Firm*—Thomas Adams

[57] ABSTRACT

A machine gun unit comprises a machine gun mounted to a support by a mounting permitting pivoting movement of the machine gun relative to the support in azimuth and/or elevation. Angle encoders provide position signals representing angular displacement of the machine gun relative to the support. An aiming system comprises a sensor, for example a CCD sensor, which provides a video signal representing a field of view for the aiming system, a display device for displaying the field of view, a manual input interface, a graphics artifact generator, and a digital signal processor (DSP). The DSP monitors the outputs of the angle encoders and controls the graphics artifact generator to combine the output of the graphics artifact generator with the output of the CCD sensor for display by the display device. Various graphics artifacts can be provided. Masks may be provided for delimiting field of fire. A cursor may be repositioned to reflect superelevation requirements. Target motion and opposing fire can be detected and highlighted. Tracers can be simulated. The weapon can also be used for surveillance, either alone or as part of a weapon system comprising a plurality of the weapons and a central command post.

3 Claims, 8 Drawing Sheets

WEAPON AIMING SYSTEM

This invention was made with Government support under Contract No. DAAA21-90-C-0055 awarded by Department of the Army. The Government has certain rights in this invention.

This invention relates to weapons, especially machine guns which are pivotally mounted and aimed manually, and is especially concerned with aiming of such weapons.

Generally, the invention is applicable to so-called "crew-served" weapons operated by one or two persons, which typically includes "light" machine guns, which fire non-explosive rounds, and "heavy" machine guns, which fire larger rounds or grenades. Hitherto, such machine guns have been aimed at the target by sighting by means of a direct-view sight on the weapon barrel, which limits the effectiveness of such weapons, especially with battlefield conditions becoming increasingly complicated.

OBJECT OF THE INVENTION

An object of the present invention is to provide an improved aiming system suitable for machine guns and like weapons.

SUMMARY OF THE INVENTION

To this end, according to the present invention, there is provided a machine gun unit comprising a machine gun mounted upon a support by means of a mounting permitting pivoting of the machine gun relative to the support in azimuth and/or elevation, and position sensing means for providing signals representing angular displacement of the machine gun relative to the support. The unit also includes an aiming system comprising sensor means for providing a video signal representing a field of view for the aiming system, display means for displaying the field of view for an operator, input means, graphics artifact generation means, and signal processing means responsive to the input means for controlling the graphics artifact generation means to combine the output of the video artifact generation means with the output of the sensor means for display by the display means. The signal processing means determines the position of the graphics artifact in the display in dependence upon the signals from the position sensors.

When using a machine gun, it is often desirable to set limits to its field-of-fire so as to avoid fratricide and/or improve effectiveness by avoiding overlap between fields of fire of other machine guns.

Accordingly, one aspect of the present invention comprises:

a gun mounted upon a support by means of a mounting permitting pivoting of the gun relative to the support means in at least one of azimuth and elevation;

position sensing means for providing position signals representing one or both of the azimuthal and elevational angular displacement of the weapon;

sensor means for providing a scene signal representing a field of view for the aiming system;

graphics artifact generation means for providing signals representing a graphics artifact comprising at least one mask delimiting an area of the field of view;

display means responsive to the sensor means and the graphics artifact generation means for displaying an image of the field of view and the graphics artifact;

user-operable input means; and signal processing means operable in response to the input of limit signals via the input means to record specific azimuthal and/or elevational orientations of the machine gun as boundaries of said area and subsequently responsive to the position sensing means initially to control the graphics artifact generation means to display at least a part of said at least one mask when the aiming point of the gun traverses one of said boundaries and thereafter to adjust the extent of said part in dependence upon further pivoting of the gun.

The graphics means may conveniently comprise a video generator and a video memory, while the position sensing means may conveniently comprise angle encoders.

Embodiments of this aspect of the invention enable the gunner to preset a field-of-fire, namely those areas of the field of view which are not masked. In one preferred embodiment, the signal processing means stores an azimuth reading as the limit of the field-of-fire and generates the mask to overlay any part of the image having an azimuthal reading in excess of the stored azimuthal reading. Preferably, provision is made for storing right-most and left-most limits and generating overlay masks in the form of curtains for image areas to the right and to the left, respectively, of the right-most and left-most limits.

The mask may take the form of a grille or other relatively transparent graphics artifact which will allow the underlying features of the scene in the field of view to be seen.

A second aspect of the invention concerns heavy machine guns which fire grenades or the like and so require substantial superelevation of the machine gun before a round is fired. It is desirable for the required degree of superelevation of the weapon to be determined quickly, at least approximately, so as to avoid wasting several rounds.

To this end, according to a second embodiment of the invention, a machine gun unit comprises:

a machine gun mounted upon a support by means of a mounting comprising a part pivotable in azimuthal directions relative to the support, the machine gun being mounted upon said part, and pivotable in elevation relative thereto;

sensor means for providing a signal representing a field of view of the sensor means;

position sensing means for providing a position signal representing at least the elevation of the weapon;

means for providing a signal representing range to a designated target;

graphics artifact generation means for providing an artifact signal representing a cursor;

display means responsive to the sensor means and the graphics artifact generation means for displaying an image of the field of view and the cursor; and signal processing means responsive to the range signal and stored ballistics data to compute a required degree of superelevation for the machine gun and apply a corresponding offset to the position signal, thereby offsetting the cursor downwards relative to the image of the field of view by an amount corresponding to the required superelevation.

In use, the user will pivot the weapon upwards until the cursor is again on the target and then fire the round. The angle through which the user must pivot the weapon to restore the cursor is, of course, the required degree of superelevation.

A third aspect of the invention concerns visual indication of the landing point of rounds fired by the weapon. Conventionally, such visual indication is provided by interspersing tracer rounds, which comprise magnesium or other suitable combustible material, with the live rounds fired by the weapon. The tracer rounds burn during flight and allow the user to see their trajectory and where they land. Such tracers have disadvantages, however, since they replace live rounds, reduce the machine gun barrel life because they ignite before leaving the barrel, and may temporarily blind the user, especially when night vision equipment is being used. With the object of overcoming these disadvantages, there is provided according to a third aspect of the invention, a machine gun unit comprising:

a machine gun mounted upon a support by means of a mounting permitting pivoting of the machine gun relative to the support in at least one of azimuth and elevation;

position sensing means for providing signals representing displacement of the machine gun relative to the support in at least one of azimuth and elevation; and an aiming system comprising sensor means for providing a scene signal representing a field of view for the aiming system, display means responsive to the sensor means for displaying the field of view, input means, graphics artifact generation means, and signal processing means, the signal processing means being responsive to the position sensing means for controlling the graphics artifact generation means to combine the output of the graphics artifact generation means with the output of the sensor means for display by the display means, the signal processing means being further operable in response to a signal from the input means to compute parameters for a trajectory of a round and supply parameters to said graphics artifact generation means, the graphics artifact generation means being operable to generate therefrom a graphics artifact representing an image of a tracer round and combine it with the scene displayed by the display means.

The signal processing means may be arranged to reduce the size and/or brightness of the graphics artifacts progressively in successive frames.

Yet another aspect of the invention concerns detecting and displaying motion of potential targets and/or the source of opposing fire while the attention of the user is otherwise engaged.

Thus, according to another aspect of the invention, there is provided a machine gun unit comprising a machine gun mounted upon a support by means of a mounting permitting pivoting of the machine gun relative to the support in azimuth and/or elevation, and position sensing means for providing signals representing angular displacement of the machine gun relative to the support. The unit also includes an aiming system, comprising sensor means for providing a video signal representing a field of view for the aiming system, display means for displaying the field of view for an operator, input means, graphics artifact generation means, and signal processing means responsive to the position sensing means and the input means for controlling the graphics artifact generation means to combine the output of the video artifact generation means with the output of sensor means for display by the display means. The signal processing means comprises interframe detection means for detecting differences between pixels of a current frame of the video signal with corresponding pixels of a preceding frame of the video signal. The signal processing means records data corresponding to the differing pixels. The graphics artifact generator uses the data for generation of corresponding graphics artifacts.

In embodiments for detecting motion, the interframe difference detecting means detects both positive and negative differences in magnitude/intensity of corresponding pixels in successive frames. In embodiments for detecting sources of opposing fire, the interframe difference detecting means may detect only positive changes in magnitude/intensity indicating muzzle flashes.

Weapons embodying one or more of the foregoing aspects of the invention may be equipped with a data interface enabling them to communicate with a central command post. According to yet another aspect of the invention there is provided a weapon system comprising a plurality of weapons and a central command post, each weapon comprising:

a gun mounted upon a support means by means of a mounting permitting pivoting of the gun relative to the support means in at least one of azimuth and elevation;

position sensing means for providing position signals representing one or both of the azimuthal and elevational angular displacement of the weapon;

sensor means for providing a signal representing a field of view of the sensor means;

graphics artifact generation means for providing signals representing graphics artifacts;

display means responsive to the sensor means and the graphics artifact generation means for displaying a combined image of the field of view and the graphics artifacts;

user-operable input means;

signal processing means operable in response to the user-operable input means and position signals to control the graphics artifact generator thereby to determine the position of the graphics artifact relative to the displayed scene;

and a data interface coupled to said central command station, the data interface being arranged to convey signals between said weapon and said central command post.

Further features of the invention will become apparent from the following description of preferred embodiments, which are described by way of example only and with reference to the accompanying drawings, in which.

Figure 1:
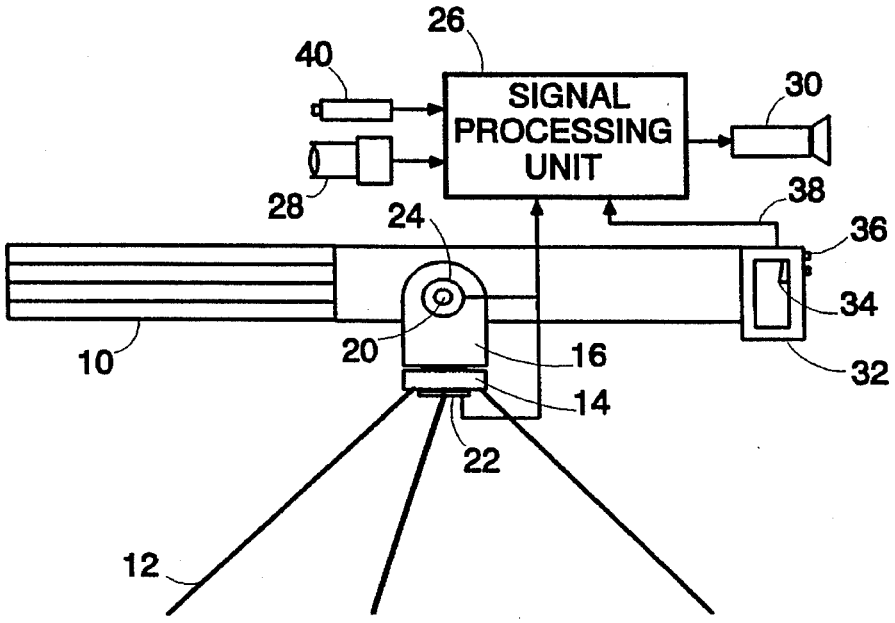
FIG. 1 illustrates a machine gun unit according to one embodiment of the invention.

In FIG. 1, which is a general diagram applicable to several embodiments of the invention, a machine gun 10 is shown mounted upon a support, in the form of a tripod 12, by means of a mounting comprising a base 14 and a cradle part 16. The base 14 couples the cradle part 16 to the tripod 12 and includes a bearing permitting azimuthal rotation of the cradle part 16 relative to the tripod 12. The cradle part 16 is secured to the machine gun body 18 by a pair of pivots 20 (only one of which is shown) permitting pivoting of the machine gun 10, relative to the tripod 12, to elevate the machine gun barrel. A first position sensor 22, coupled to base 14, detects azimuthal rotation of the machine gun 10 relative to the tripod 12. A second position sensor 24, coupled to cradle part 16, detects elevational pivoting of the machine gun 10 relative to the cradle part 16.

The position sensors 22 and 24 supply azimuth and elevation signals, respectively, to a signal processing unit 26 which could, and usually would, be mounted upon the body of the machine gun 10, but is shown separate for convenience of illustration.

An image sensor 28 is mounted upon the machine gun 10 and is "bore-sighted" i.e. has its optical axis aligned with the bore axis of the machine gun. The image sensor 28 is of the CCD array kind used in portable video cameras and supplies an analogue video signal representing the field-of-view. The output of sensor 28 is coupled to the signal processing unit 26 which relays the video signal to a display device 30. The display device 30 comprises a miniature cathode ray tube (CRT) equipped with a lens and an eyecup, conveniently of the kind used with camcorders, to allow close-up viewing of the CRT. Where close-up viewing is not required, the display device 30 may comprise a monitor. The display device 30 may be mounted directly upon the weapon but, preferably, and as shown in FIG. 1, is positioned away from the weapon so that the user's head need not be adjacent the weapon.

A handgrip 32 carries the trigger 34 and a set of thumbswitches 36 which are connected to the signal processing unit 26 by line 38. The thumbswitches 36 and, in some embodiments, the trigger 34 constitute a user-operable input means enabling the user to control the aiming system by way of the signal processor 26. A laser rangefinder 40 has its optical axis aligned with the bore of the machine gun 10 and is operable by a "range" or "designate target" switch which, conveniently, is one of the switches 36. Upon operation of the "range" switch, the laser rangefinder 40 measures the range to the designated target and supplies the measurement to the signal processing unit 26. In embodiments of the invention where range is not needed, the laser rangefinder 40 may be omitted.

Figure 2:
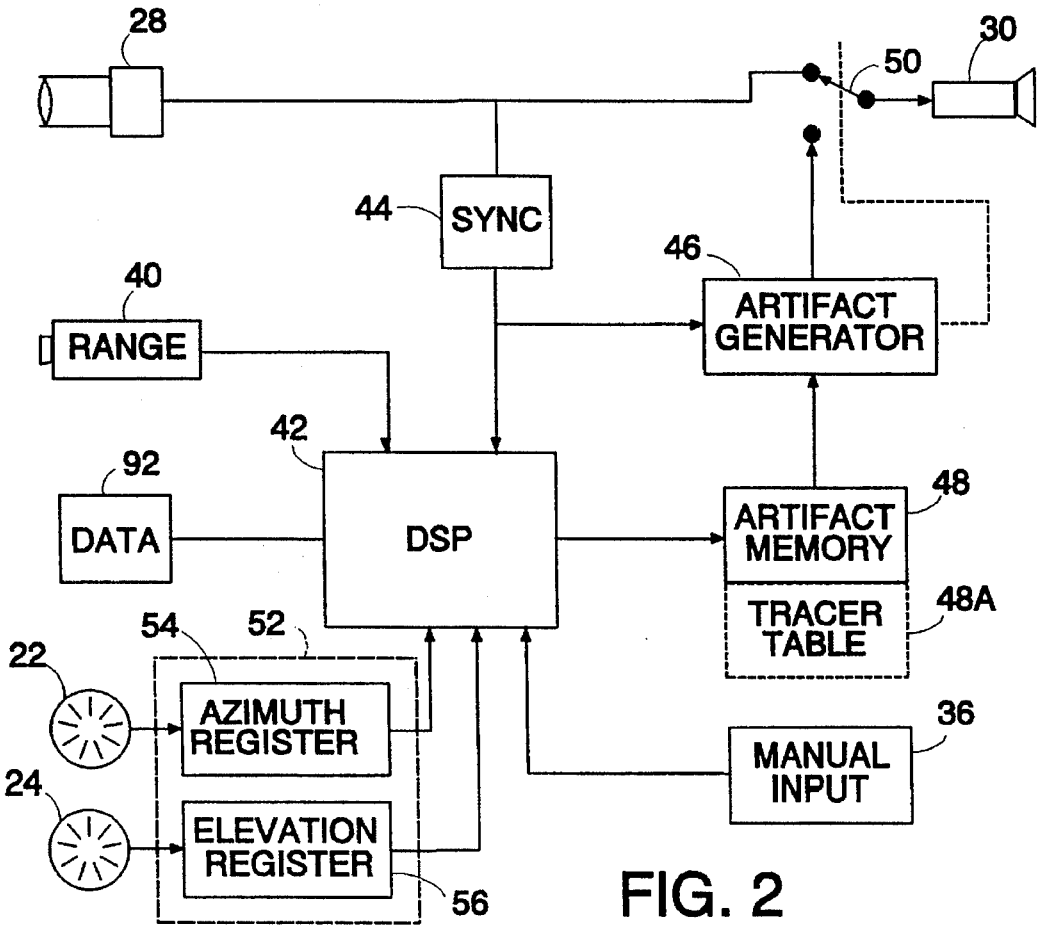
FIG. 2 is a block schematic diagram of an aiming system of the unit of FIG. 1.

Referring now to FIG. 2, the signal processing unit 26 comprises a digital signal processor (DSP) 42, a synchronization circuit 44, a graphics artifact generator 46, an artifact memory 48, a high speed switch 50, a sensor interface 52, and azimuth and elevation registers 54 and 56, respectively. Although the azimuth and elevation registers are shown in FIG. 2 as part of the signal processing unit 26, in practice they may be integrated physically with the corresponding position encoders 22 and 24, respectively. The encoder interface 52 converts the output of the azimuth encoder 22 and elevation encoder 24 into corresponding azimuth and elevation readings for the weapon and stores the instantaneous readings in the azimuth register 54 and elevation register 56, respectively. The position encoders 22 and 24 may be of the analogue kind or the digital kind, the encoder interface 52 being selected accordingly.

During each frame of the video signal, the DSP 42 accesses the azimuth register 54 and elevation register 56 and uses the most recent values of azimuth and elevation to update the artifact memory 48.

The artifact memory 48 comprises a video store, conveniently in the form of a random access memory (RAM), which stores the equivalent of one screen of the display device 30, i.e. one full frame of the video signal from sensor 18. There is a one-to-one correspondence between the pixels of the CCD sensor 28, the locations in the artifact memory 48, and the pixels of the display device 30. The artifact memory 48 stores data representing a set of pixels for a graphics artifact in the form of a cursor 62 (see FIG. 3), each pixel being represented by a word of eight bits. Each eight bit word comprises seven bits which will determine the predetermined luminance value of the artifact pixel to be generated. The eighth, most significant bit is used as a flag or toggle to control the graphics artifact generator 46. When the DSP 42 writes data words into artifact memory 48 to create a graphics artifact, it will set the most significant bit of each word to one. In each frame, as the graphics artifact generator 46 scans the artifact memory 48, it will determine the state of the eighth bit. If it is zero, the graphics artifact generator 46 does not generate an artifact pixel and does not toggle high speed switch 50. When it detects that the eighth bit is a one, however, the artifact generator will respond by generating an artifact pixel, with its luminance determined by the remaining seven bits, and toggling the switch 50 to substitute it for the corresponding scene pixel of the video signal.

Thus, each time it receives a frame pulse from sync circuit 44, the graphics artifact generator 46 scans the artifact memory 48 in "raster scan" fashion, uses the data to generate a corresponding cursor signal, and operates high speed switch 50 to insert it into the video signal. The high speed switch 50 operates at 10 MHz., the pixel rate, and is controlled by the graphics artifact generator 46 on a pixel-by-pixel basis to supply to the display device 30 either a "scene" pixel from the image sensor 28 or an artifact pixel generated by the graphics artifact generator 46 itself. When the value of the eighth bit of a word from the artifact memory 48 is zero, the graphics artifact generator 46 will detect this zero condition and leave the switch 50 in the normally closed position shown in FIG. 2, allowing the video signal from sensor 28 to pass uninterrupted to display device 30, which thus displays a "scene" pixel. Whenever the eighth bit is not zero, the graphics artifact generator 46 will generate a corresponding artifact pixel and will operate the switch 50 to substitute the artifact pixel for the corresponding pixel of the video signal representing the scene. The luminance of this artifact pixel will be determined by the value, from 1 to 127, represented by the corresponding word stored in artifact memory 48.

The programming of the DSP 42 includes a subroutine which "draws" the cursor by writing the appropriate pixel data in the artifact memory 48. The addresses of the cursor pixel words it writes in artifact memory 48 are determined relative to the frame pulse so that, in the scene displayed display device 30, the cursor 62 is "drawn" at a position corresponding to the aiming point of the weapon. Before the next frame pulse is received by the graphics generator 46, and the cursor 62 redrawn, the DSP 42 updates the artifact memory 48. The apparent position of the cursor 62, or other artifacts to be described later, can be changed by changing the addresses of the artifact pixel words. For most of the embodiments to be described herein, the cursor is always positioned in the center of the artifact memory 48, and hence the displayed image, since the CCD sensor 28 is bore-sighted to the gun and the artifact memory 48 has a one-to-one correspondence with the pixels of the CCD sensor 28 and the display device 30. Thus, the artifact pixels are at a fixed position relative to the frame pulse and independent of the readings of the position encoders 22 and 24. They can, however, be offset from the boresight when, for example, ballistic offsets are used, as will be described later.

With suitable selection of the system components and programming of the signal processing unit, various functions can be provided by aiming systems embodying the invention.

Figure 3:
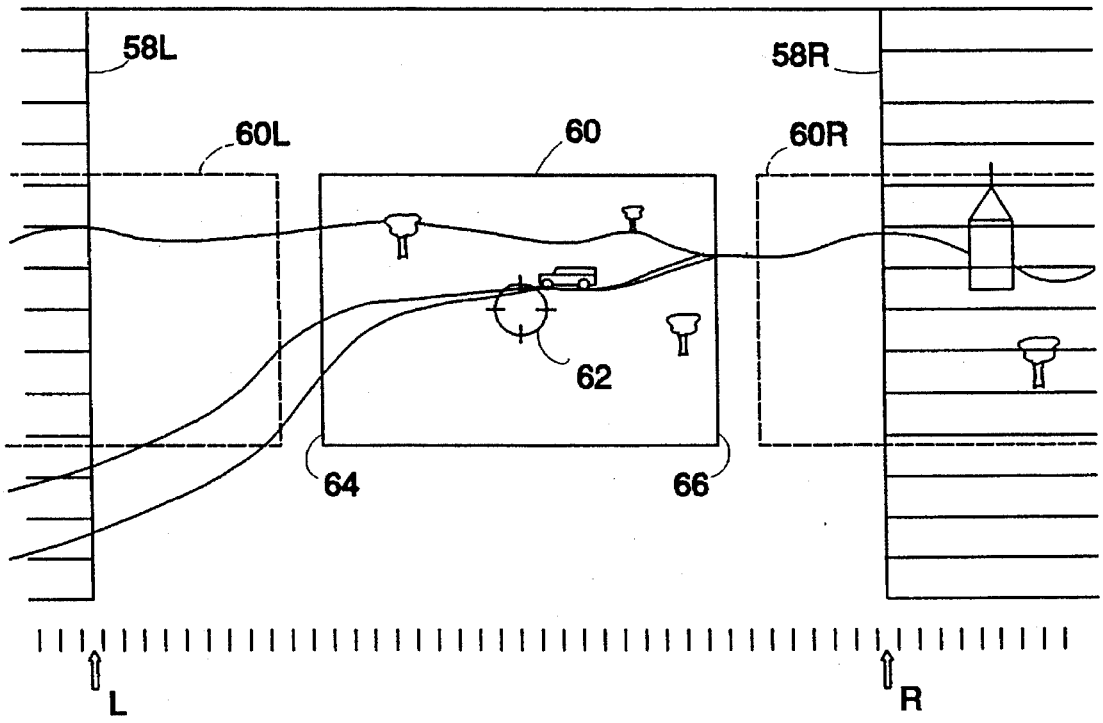
FIG. 3 illustrates the display seen by a user of the unit, showing an overlay for limiting field-of-fire.

In an embodiment of the aiming system for displaying limits to the field-of-fire of the weapon, the DSP 42 is also programmed with a subroutine which will write into artifact memory 48 data representing artifact pixels which will create graphics artifacts in the form of masks 58L and 58R to be displayed with the image of the field of view as illustrated in FIG. 3. Whereas the DSP 42 refreshes the data for cursor 62 in every frame, it will only write the data to "draw" the masks in certain circumstances. When drawn, the "mask" graphics artifacts are in the form of an open grille, the resulting effect being as if "curtains" are overlaid upon parts of the scene.

For convenience of description, the azimuth scale is represented as a horizontal scale at the bottom of FIG. 3, although it is not usually displayed. The edges of the mask or "curtains" 58L and 58R define the boundaries of the permitted field-of-fire for the weapon and are preset by the operator by means of two of the thumbswitches 36, designated LEFT and RIGHT. The DSP 42 has two registers (not shown) also designated as LEFT and RIGHT.

As shown in FIG. 3, the field of view 60 displayed by the display device 30 may be much less than the range set by the edges of left and right "curtains" 58L and 58R, respectively. In order to set the leftmost limit 58L of the field-of-fire, the operator will pan the weapon to the left until the cursor 62 is aligned with a scene feature which constitutes the leftmost limit of the field-of-fire and will then operate the LEFT thumbswitch. The DSP 42 detects operation of the thumbswitch and stores in the LEFT register the current azimuth reading L from the azimuth register 54 (FIG. 2). Likewise, when the user operates the RIGHT thumbswitch, the DSP 42 stores the current azimuth reading R from azimuth register 54 in the RIGHT register.

In normal operation, the DSP 42 monitors the frame synchronization pulses from synchronization circuit 44 and, in each frame period, adds to the instant azimuth reading in azimuth register 54 an amount corresponding to one half of the field of view, and compares the results with the value stored in the RIGHT register. Also, it subtracts a similar amount and compares the result with the value stored in the LEFT register. The azimuth reading needs to be adjusted in this way because the reading in the register 54, at any instant, represents the angular position of the center of the display relative to the viewed terrain. A portion of the mask will be drawn, however, once the left edge 64 of the field of view traverses the limit 58L, or the right edge 66 of the field of view traverses the limit 58R. Hence, if the field of view is 10 degrees, the DSP 42 must adjust the azimuth reading by the equivalent of 5 degrees in each direction in order to determine the left edge azimuth and right edge azimuth readings. For left edge azimuth readings less than the reading in the LEFT register, the MASK subroutine will draw a vertical line from top to bottom of the screen at the LEFT limit and a series of horizontal lines from the LEFT limit to the edge of the screen. In like manner, when the right edge azimuth reading is greater than the reading in the RIGHT register, the DSP 42 will write into the artifact memory 48 data to "draw" the appropriate portion of the mask 58R to the right of the RIGHT limit. Graphics generator 46 will raster scan the artifact memory as before and draw the masks 58L and 58R in the displayed scene.

So long as the field of view 60 does not embrace an azimuth reading less than L or greater than R (assuming azimuth values increase to the right), the DSP 42 will write only cursor data into the artifact memory 48 in each frame. The mask or "curtains" 58L/58R will not be displayed. This corresponds to a field of view 60 as represented in the solid box in FIG. 3. When the weapon is panned so far to the left that part of the field of view is beyond azimuth reading L, as illustrated by box 60L, the left mask or curtain 58L will encroach upon the field of view. When the weapon is panned to the right, the left mask or curtain 60L will disappear. Eventually, when azimuth reading R is reached, as illustrated by box 60R, the right mask or curtain will begin to appear. Because the masks are in the form of an open grille or mesh, features of the scene beneath the masks or curtains 58L and 58R can still be seen.

It will be appreciated that other forms of mask could be employed. While for most situations it will be sufficient to limit the field-of-fire in azimuth only, additional registers may be provided to enable elevational limits to be set in a similar way. Thus, elevation readings from the elevation encoder 24 stored in elevation register 56 (FIG. 2) would be repeatedly scanned by the DSP 42 which would include a HIGH register and a LOW register for recording the high and low readings as set by the operator using HIGH and LOW thumbswitches in a similar manner to the setting of azimuthal limits respectively.

Figure 4:
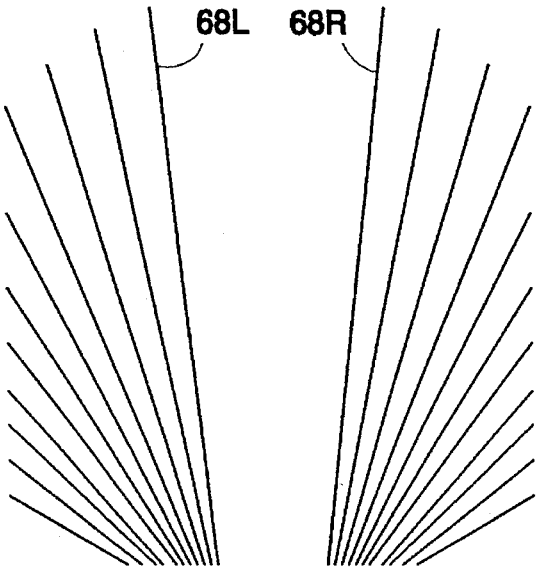
FIG. 4 illustrates an alternative overlay for designating a field-of-fire "corridor"

The invention is not limited to restricting field of view by masking only azimuthal or elevational extremities. As illustrated in FIG. 4, a pair of fan-like masks 68L and 68R may each comprise a series of lines diverging towards the top of the field of view so as to define between the masks a corridor as a field-of-fire. It is also envisaged that more complex field-of-fire areas could be delimited. For example, the field of view could be segmented into grids and selected ones of the grids masked. More irregular field-of-fire zones could be created by entering a series of points delimiting the area to be excluded and programming the DSP 42 to enclose the area by joining the points. Alternatively, a thumbswitch might be held down to record the azimuth and elevation readings while the user pivoted the weapon so that the cursor traced an irregular outline to be excluded. Software for implementing such alternatives might conveniently take the form used in computer-aided drafting.

In the described embodiments, the artifact pixels are substituted for scene pixels. Of course, if desired, the pixels could be superimposed or the mask combined with the scene in some other way. For example, rather than substitute artifact pixels, the masked areas could be depicted in reverse video.

Figure 5A:
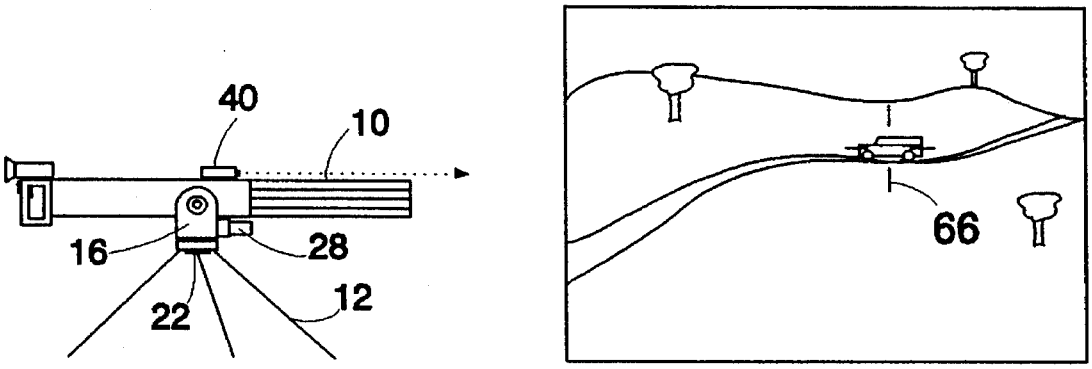
FIGS. 5A, 5B and 5C illustrate operation of a second embodiment of the invention involving superelevation of the weapon.
Figure 5B:
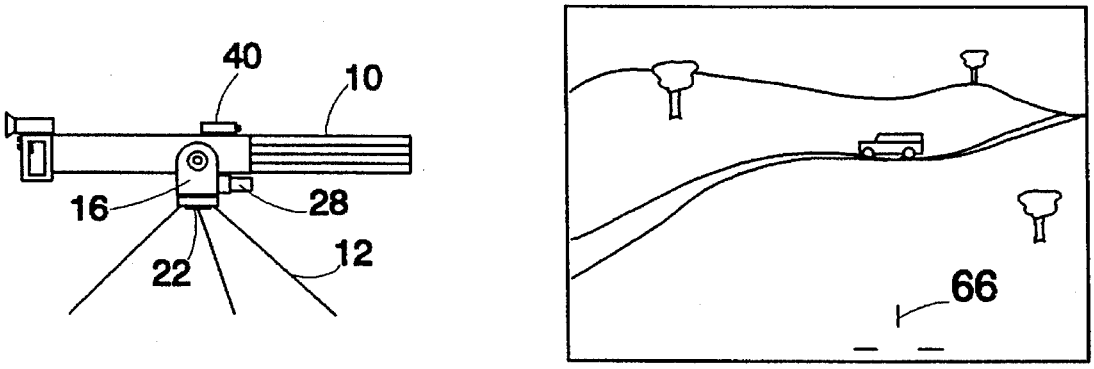
Figure 5C:
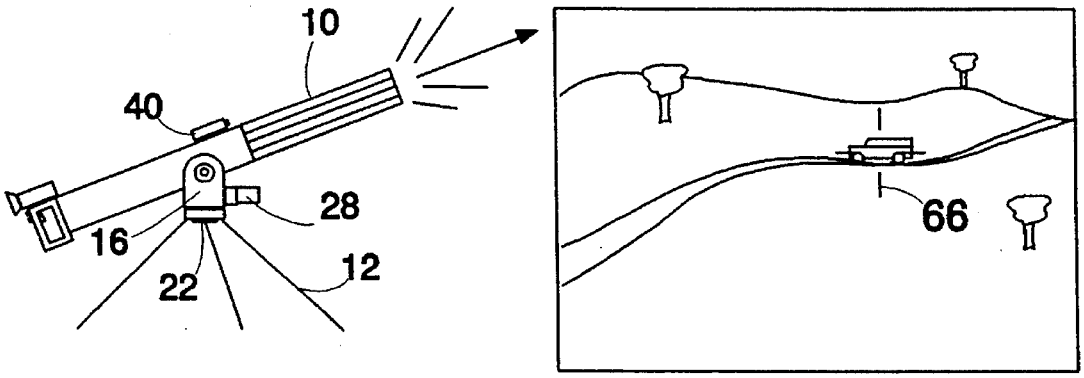

The invention is not limited to controlling field-of-fire. FIGS. 5A to 5C and FIG. 6 illustrate application of the invention to machine guns which fire larger rounds, like grenades, and so require a significant amount of superelevation, perhaps as much as 30 degrees. In FIGS. 5A to 5C, components of the aiming system which correspond to those illustrated in FIGS. 1 and 2 are identified by the same reference numbers. A major difference is that the image sensor 28 is mounted upon the cradle part 16 and so will only move in azimuth. As before, azimuthal movement of the cradle part 16 relative to the tripod 12 is measured by a position sensor in the form of angle encoder 22 and elevational movement of the machine gun 10 relative to the cradle part 16, and hence the tripod 12, is measured by angle encoder 24. Another difference from the field-of-fire embodiment is that the artifact generator 46 and artifact memory 48 are configured to generate only a cursor 66 as the graphics artifact for display with the field of view by the display device 30. Also, the DSP 42 includes "offset" registers, the purpose of which is to store offset values calculated by the DSP 42 taking account of ballistic offsets for azimuth and elevation as will be described later.

Also, whereas the cursor 66 of the field-of-fire system was aligned with the boresight in both azimuth and elevation, in this embodiment, where the CCD sensor 28 is fixed to the cradle 16, the cursor 66 is only aligned with the boresight in azimuth. In this case, the elevation encoder 56 must be read to determine the "vertical" position of the cursor in the display. The horizontal position of the cursor 66 will always be in the center of the display unless, as mentioned previously, ballistic offsets are applied.

The user will position the tripod 12 so that the sensor 28 surveys the scene of interest. In this case, the sensor 28 may have a wider field of view than that used in the system of FIG. 2 though, in practice, 10 degrees seems to be adequate. In this embodiment, a laser rangefinder 40 is used. As mentioned previously, the laser rangefinder 40 is fixed to the barrel of the machine gun and "bore-sighted" to it, i.e. it always points to the aiming point of the weapon. As before, the DSP 42 will ensure that the cursor 66 is aligned with the boresight of the weapon.

With the cursor 66 on the target as shown in FIG. 5A, the user operates the laser rangefinder 40 by means of one of the thumbswitches 36 to "designate the target". The DSP 42 detects operation of the switch and operates the laser rangefinder 40 to determine the range of the target overlaid at that instant by the cursor or cross-hair and supply the range measurement to the DSP 42. Using ballistic data previously entered into its memory, and the measured range, the DSP 42 will calculate offsets, primarily in elevation, and offset the cursor 66 downwards. The user will elevate the weapon until the cursor 66 is again on target and fire the round.

Operation will now be described more specifically with reference also to the flowchart of FIG. 6. When the aiming system is switched on, or reset, the DSP 42 clears the azimuth offset and elevation offset registers as indicated by step 70. In step 72, the DSP 42 then awaits a frame pulse from sync circuit 44. When a frame pulse is received, the DSP 42 reads the azimuth and elevation registers 54 and 56, respectively, (step 74) and scans the "Designate Target" thumbswitch, as in decision step 76. If the Designate Target switch has not been operated, the DSP 42 will proceed to step 78 and supply the readings from the azimuth register 54 and elevation register 56 to the artifact memory 48 to determine the position of the cursor 66. The artifact generator 46 will then draw the cursor 66, as per step 80 by interspersing cursor pixels with the scene pixels in the manner previously described. The DSP 42 then scans the Designate Target thumbswitch again, as in step 82, to determine whether or not it has been reset and hence the target "undesignated". Additionally, or alternatively, the DSP 42 may scan the trigger 34 to determine whether or not the weapon has been fired. If it has not been fired a predetermined time after the target was first designated, the DSP 42 may deem that the target is no longer designated.

Figure 6:
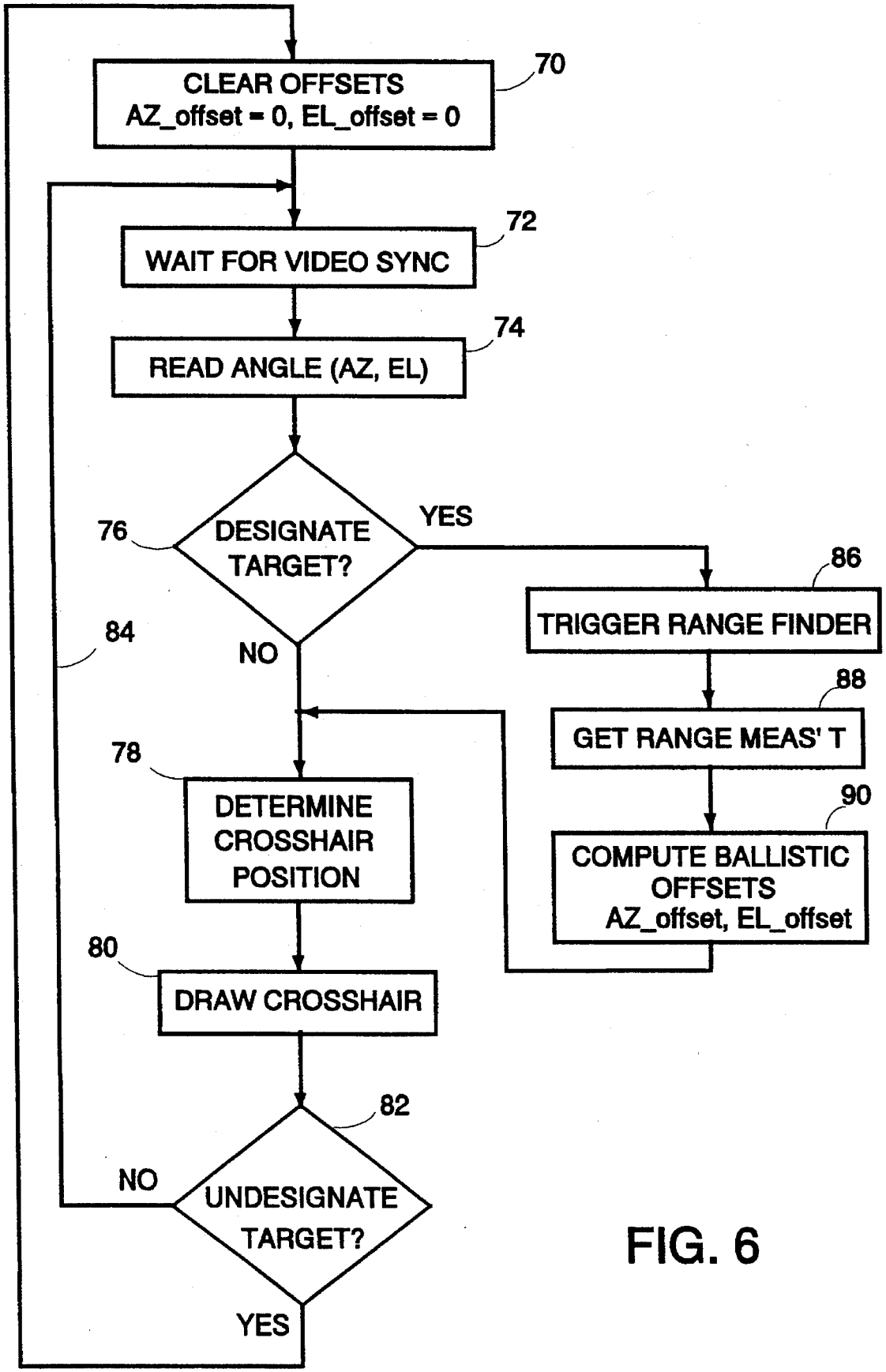
FIG. 6 is a flowchart illustrating processing in the second embodiment.

In this mode, the DSP cycles through the loop 84 of the flowchart in FIG. 6. Each time the DSP 42 receives a frame synchronization pulse from synchronization circuit 44, it reads the azimuth and elevation registers 50 and 60, respectively, and scans the "designate target" switch. So long as the "designate target" switch has not been operated, the DSP 42 uses the azimuth and elevation readings to update the contents of artifact memory 40 as indicated by step 78. Hence, as the user moves the aiming point, the DSP 42 merely adjusts the position of the cross-hairs 66 to reflect movement of the weapon while the user surveys the scene to select a target.

When the user operates the "designate target" thumbswitch, with the cursor 66 positioned upon the target in the display, the outcome of decision step 76 will be positive, and the DSP 42 will trigger the rangefinder 40, as in step 86. The rangefinder 40 determines the range in the usual way and returns the range measurement to the DSP 42, as in step 88. The DSP 42 uses the range measurement and, where applicable, other input data such as cross-wind speed, to calculate ballistic offsets as in step 90. For the most part, the main ballistic offset will be in elevation. The azimuthal offset will usually be much less and, in some cases, might be dispensed with altogether. The ballistics information may be inputted by way of the manual interface or input means 36 and/or a data interface 92 (FIG. 2).

Having completed the "offset" loop comprising steps 86, 88 and 90, the DSP 42 returns to step 78 and this time determines the position of the cursor 66 taking account of the ballistic offset values. More particularly, in each frame the DSP 42 will offset all values written in the artifact memory 48 by the appropriate amount so that the cursor 66 is shifted relative to the displayed scene, as shown in FIG. 5B, in the opposite direction to that in which the machine gun barrel must move. If the offset is greater than the distance to the edge of the display, the cursor 66 merely remains at the edge of the display until the machine gun barrel has been elevated an appropriate amount. In this way, the cursor 66 is never lost beyond the boundaries of the display.

Once the cursor 66 has been displaced, indicating that the ballistic offsets have been computed, the user repositions the barrel until the cursor is aligned once more upon the target, as illustrated in FIG. 5C, and fires the round. In realigning the cursor 66, the user automatically adjusts the machine gun barrel by the required amount of superelevation and, where applicable, azimuthal lead. It will be appreciated that the user does so without losing sight of the target in the display which leads to improved effectiveness.

In most cases, if a different field of view is needed, the user will merely reposition the tripod. In the event that the field of view of the sensor is insufficient, and a greater degree of elevation is needed, it would be possible to provide the base member 14 with a bearing to permit elevational movement and a lock for locking it relative to the weapon. The user could then move the weapon about, with the bearing free, and select the target. Designation of the target could automatically lock the bearing and permit further elevational movement by means of the one bearing only. The DSP 42 could then measure the offset as the output of a second position encoder associated with the movable bearing.

Figure 7:
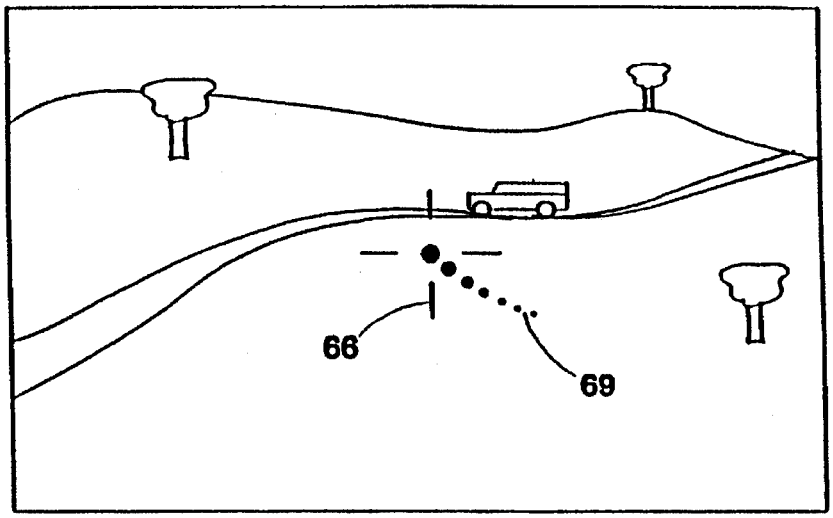
FIG. 7 depicts video tracers generated in a further embodiment of the invention.

A third embodiment of the invention enables tracers to be simulated using graphics artifacts. The machine gun is similar to that of FIG. 2, but differs in that its trigger 34 is of the double detent kind and the artifact memory 48 has a segment 48A, shown in broken lines in FIG. 2, for storing video tracer data from the DSP 42, as will be described later. In use, the user will initially aim the weapon so that the cursor 66 is on the designated target and depress the double detent trigger switch to its first position. This will operate the rangefinder 40 to obtain a range measurement and supply it to the DSP 42. The DSP 42 will use the range reading and ballistics information such as wind speed and direction, round mass, and so on, previously stored by DSP 42, to calculate the landing point of a tracer round. The DSP 42 will then store in the artifact memory 48 the data required to generate a graphics artifact in the shape of a spot at the calculated landing point. Artifact generator 46 will use the tracer data from the artifact memory 48 to generate a set of pixels for the spot and combine them with the displayed image in the manner previously described. With the trigger still depressed to only the first position, the user can then move the weapon to "walk" the tracer onto the desired target as would be done with tracers. At that point, the user can depress the trigger further to fire the actual round. In succeeding frames, the DSP 42 will update the data for the video tracer artifacts in the artifact memory 48 so as to simulate the movement of the tracer towards the target as the user adjusts the aiming of the weapon to "walk" the tracers onto the target. The DSP 42 may also adjust the parameters so that the dot will be smaller and fainter in later frames until eventually it will disappear altogether as the DSP 42 erases the tracer data from artifact memory 48. FIG. 7 shows the display seen by a user who is operating the weapon in "tracer" mode while moving the aiming point upwards from right to left, the video tracers comprising a succession of dots 69.

When using a conventional weapon which fires real tracers, the user will observe the tracer to first rise and then fall, due to the ballistic trajectory, and diminish in brightness the further it is from the weapon. In order to achieve greater realism, the DSP 42 may adjust the tracer data, primarily by offsetting the elevation and luminance, so as to modify the tracer's position relative to the scene image and cause it to fade with time. Consequently, the user will see a series of dots which appear at the middle of the bottom of the display, as if emanating from the weapon, traverse a ballistic trajectory, and extinguish at a position which the DSP 42 determines to be the point at which the tracer round would have landed. The closer the dots are to the target, the smaller and fainter they will be.

It will be appreciated that the DSP 42 will only estimate the landing point of the tracer, whereas a real tracer would give the true landing point. However, the use of video tracers saves valuable ammunition and wear and tear on the weapon, avoids blinding the user, and, importantly, does not divulge the position of the user to the enemy.

Figure 8:
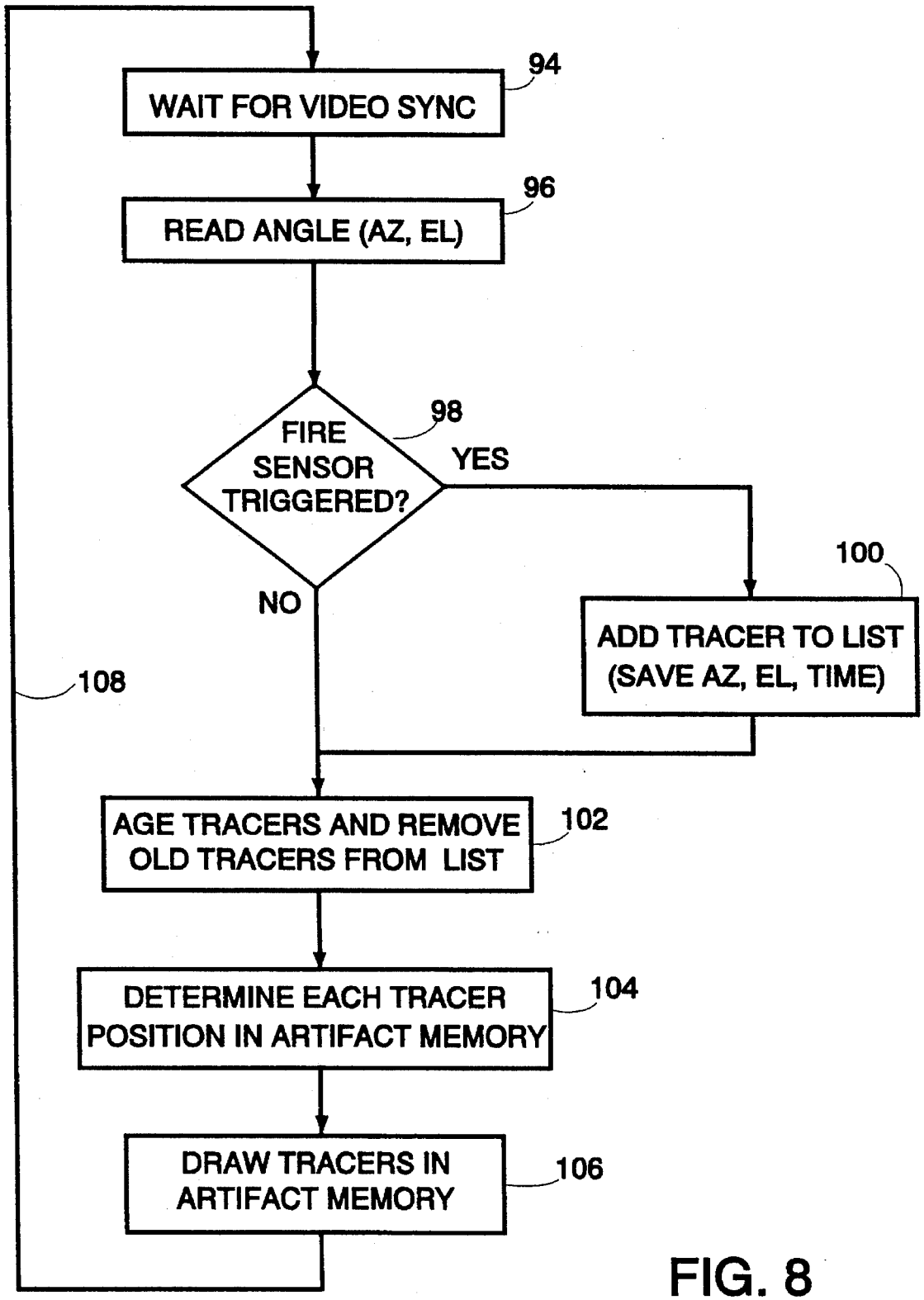
FIG. 8 is a flowchart for the video tracer embodiment.

Operation of the aiming system to generate these video tracers will now be described with reference to the flowchart in FIG. 8. Having detected a frame synchronization pulse in step 94, the DSP 42 reads the azimuth and elevation from registers 54 and 56, respectively, in step 96, and scans the fire sensor switch, i.e. the first position of the trigger 34, in step 98. If the trigger has been depressed to the first detent position, in step 100 the DSP 42 uses a tracer subroutine to compute the data for generating the appropriate tracer and adds it to a table, in the Tracer Table segment 48A of the artifact memory 48, as shown in broken lines in FIG. 2, together with the azimuth, elevation and time.

If the "fire sensor" switch has not been operated, however, and the result of decision step 98 is negative, the DSP 42 proceeds to step 102 and "ages" the data in Tracer Table 48A, by removing from the list any tracers which have been in the list for a predetermined length of time, and by reducing the luminance of each of the remaining tracers according to its time on the list. In step 104, the DSP 42 determines the position of each video tracer in the displayed scene, taking account of the instant azimuth and elevation readings, and in step 106 writes the tracer data into artifact memory 48. The DSP 42 then returns via loop 108 to step 94 to await the next frame pulse. As before, upon receipt of each frame pulse, the graphics artifact generator 46 raster scans the artifact memory 48, generates a set of tracer pixels, in this case forming a spot for each tracer, and intersperses them with the scene pixels to combine the tracer(s) with the displayed scene.

The type and duration of the tracers may be adjusted by the user to suit particular situations. In some situations, it is desirable to have the tracer persist for a relatively long period of time, typically several seconds. As more tracers remain on the display, however, each needing to be adjusted to compensate for movement of the weapon, the processing burden on the DSP 42 may become too much, causing a visible lag in updating of the tracers. In such circumstances, the gunner may reduce the persistence time.

It will be appreciated that the use of video tracers is not limited to battlefield operations, but could also be used for training purposes.

Figure 9:
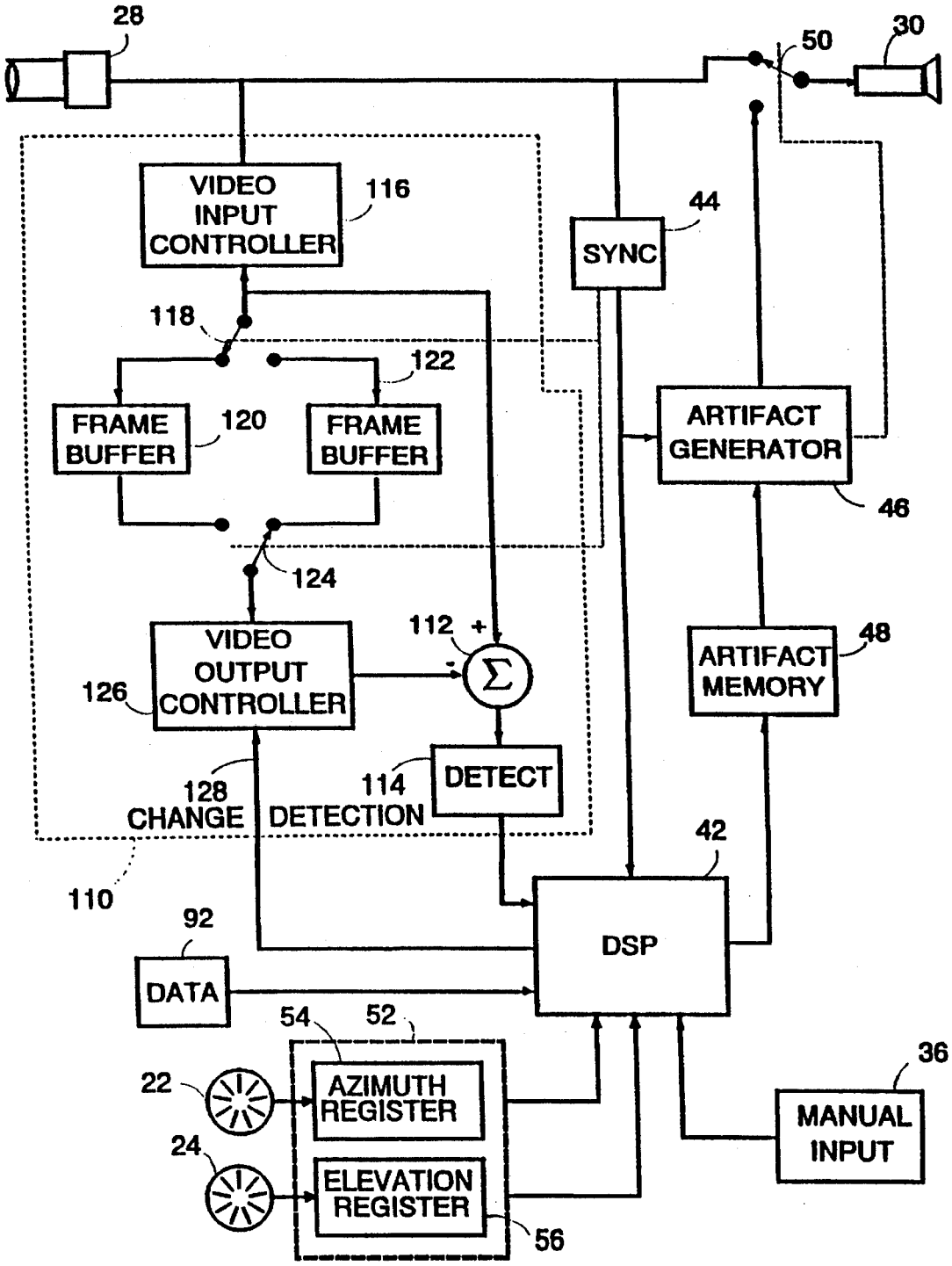
FIG. 9 illustrates a fourth embodiment of the invention for detecting and indicating target motion.

FIG. 9, in which components corresponding to those in preceding Figures have the same reference numerals, illustrates an embodiment of the invention suitable for detecting and indicating changes in the scene. The aiming system is similar to that of FIG. 2, but also comprises change detection means 110, a summation device 112 and differencing means 114. Also, one of the user-operable thumbswitches 36 is designated for operation to initiate detection of changes in the field of view of the image sensor 28.

As shown in FIG. 9, the change detection means 110 comprises a video input controller 116 with its input connected to the output of sensor 28 and its output connected to a first selector switch 118, which is connected to the respective inputs of two one-frame buffers 132 and 134, respectively. The outputs of the frame buffers 120 and 122 are connected by way of a second selector switch 124 to the input of a video output controller 126. The outputs of the video input controller 116 and video output controller 126 are connected to the positive and negative inputs, respectively, of the summation device 112. The output of the summation device 112 is connected to the input of detector 114, the output of which is connected to the DSP 42. The switches 118 and 124 are controlled by sync circuit 44 to toggle each frame to connect each of the frame buffers 120 and 122 in turn between the video input controller 116 and the video input controller 126. As can be seen from FIG. 9, the switches 118 and 124 are oppositely poled so that, at any instant, data will be being written into one of the frame buffers while the previous frame of video data is being read out of the other frame buffer.

The frame buffers 120 and 122 are memory devices which store a frame of video data in a similar manner to artifact memory 48. In operation, the video input controller 116 digitizes the frame of video signal from sensor 28 and writes it into the frame buffer 120 or 122 selected by switch 118. At the same time, the video output controller 126 reads out via switch 124, the frame of video data from the preceding frame to summation device 112. The summation device 112 computes the difference in intensity between pixels in the current frame and the corresponding pixels in the preceding frame. In order to eliminate changes caused by angular movement of the weapon between the successive frames, the DSP 42 monitors the azimuth and elevation readings from azimuth and elevation registers 54 and 56, respectively, and supplies correction signals on line 128 to the video output controller 126. The video output controller 126 shifts the position within the frame buffer at which it starts to read out the digital video data. This causes a compensating relative shift in the frame of data applied to the summation device 112.

The corrected data is supplied to the detection means 114 which detects pixels in the current frame which have changed in intensity relative to the corresponding pixels in the previous frame by more than a predetermined threshold value. The detection means 114 detects both large positive and large negative values of luminance to detect changes caused by movement of potential targets. If the two frames under comparison cover different areas, perhaps because the weapon moved, pixels in areas which do not overlap will be excluded from the processing.

In response to the data from detector 114, the DSP 42 writes into the graphics artifact memory 48 data for a graphics artifact in the form of highlighting of the different pixels and hence of the movement of the potential targets. The highlighting conveniently takes the form of an increase in luminance of the "differing" pixel.

Figure 10:
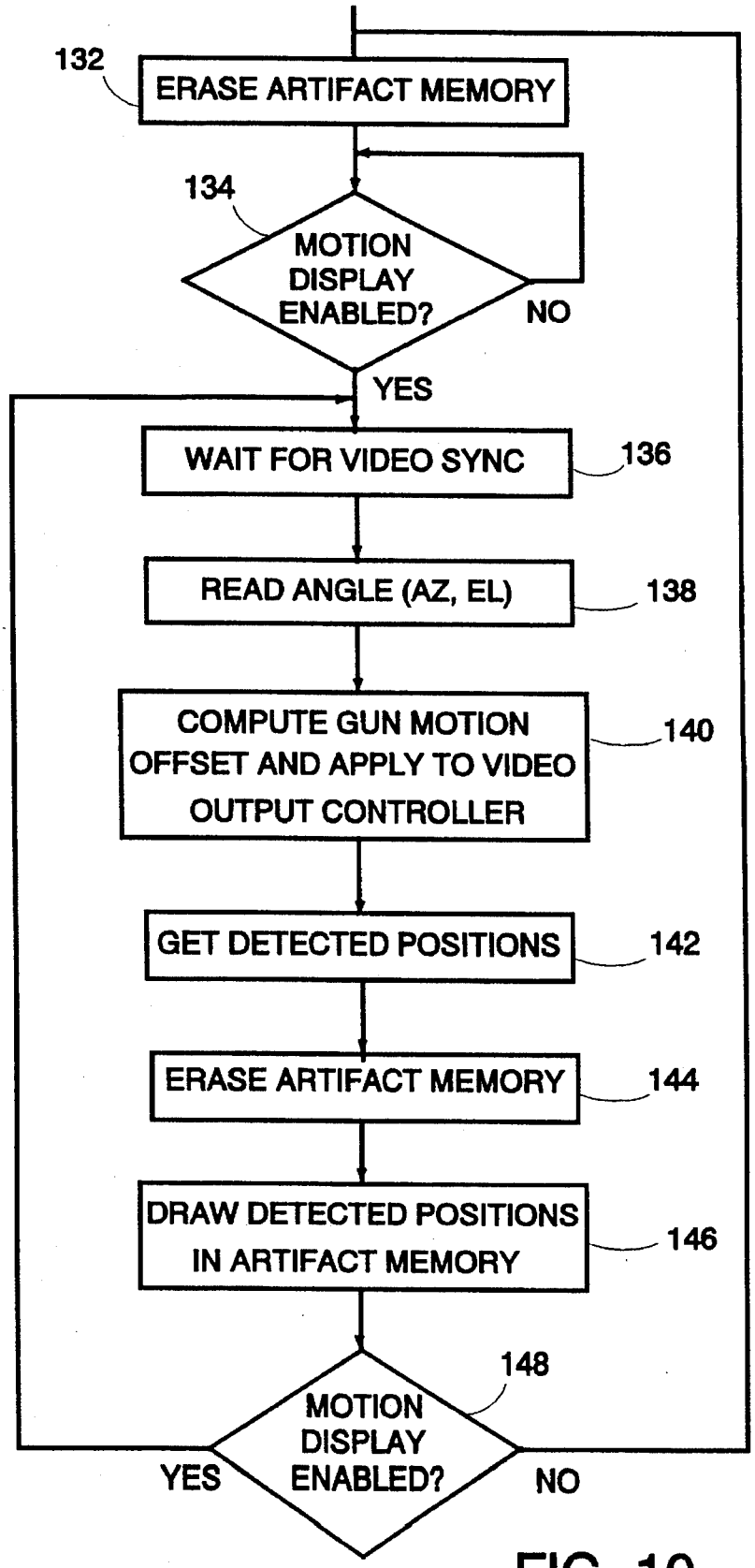
FIG. 10 is a flowchart for the embodiment of FIG. 9.

For detecting interframe motion of potential targets, the DSP 42 will be programmed to operate according to the flowchart shown in FIG. 10. In step 132, the DSP 42 clears the artifact memory 48 and in step 134 scans the thumbswitches 36 until it detects that motion detection has been initiated by operation of the Detect Motion thumbswitch. When it receives the next frame pulse, step 136, the DSP 42 reads the azimuth and elevation registers 54 and 56, respectively, in step 138. In step 140, the DSP 42 subtracts the current azimuth and elevation readings from the readings for the preceding frame to determine interframe gun motion, and converts the difference into an equivalent number of pixels. This involves multiplying the angle encoder measurement by a factor representing the ratio between the angle encoder measurement and a corresponding distance in pixels. This ratio will usually change only if the field of view of the optics changes. The DSP 42 supplies the number of pixels as an offset signal to the video output controller 126. In step 142, the DSP 42 reads the positions of the changed pixels from the detector 114, ensures in step 144 that the artifact memory has been erased, and in step 146, writes into artifact memory 48 the data for generating the graphics artifacts at the detected positions. The data includes coordinates for the changed pixels artifacts and sets the luminance to maximum or saturation. The graphics generator 46 uses the data from the artifact memory 48 to generate substitute pixels and intersperses them with those from the image sensor 28 as previously described. Since the DSP 42 has increased the luminance, any changes will be highlighted in the displayed scene.

In step 148, the DSP 42 scans the thumbswitches 36 again. If the "Detect Motion" thumbswitch has not been reset, it returns to step 136 and repeats the sequence. If, however, step 148 reveals that the "Detect Motion" thumbswitch has been reset, the DSP 42 returns to step 132, erases the artifacts from memory 48, and continues to scan the thumbswitches until motion detection is enabled again. Duplication of the steps of scanning the "Detect Motion" thumbswitch and erasing the artifact memory 48 (steps 132,134, 144 and 148) ensure that the graphics artifact generator 46 does not continue to highlight the motion in the display when motion detection has been discontinued.

The DSP 42 may maintain the changed pixel data causing the highlighting to persist for a predetermined length of time. The display will show all movement during that time, continuous movement showing as a highlighted trail. Consequently, the display will show not only the moving target but also where the movement commenced, which may be of significance. This is of advantage for surveillance purposes, since the weapon can be left unattended. When the weapon is actually being used, however, a shorter persistence may be preferred, for example, just long enough to register movement in one area of the field of view while the user's attention was focused on a different area.

With only slight changes to the detection device 114 and the programming of the DSP 42, the system may also detect and indicate opposing fire. When opposing fire occurs, gun flash will show as a sudden increase in intensity of a group of pixels. The summation device 112 and detection device 114 will detect large positive changes between corresponding pixels of successive frames, indicative of gun flashes and highlight them as before. Where both motion detection and opposing fire detection are used at the same time, the thresholds of the detector 114 and the programming of the DSP 42 may be arranged to discriminate between slight movements and gun flashes and emphasize the latter in some way, for example by increasing the luminance to a maximum. An opposing gun flash would be characterized by a cluster of pixels that had a large positive change in intensity. Movements of objects in the scene would cause both positive and negative intensity changes of a smaller magnitude.

Figure 11:
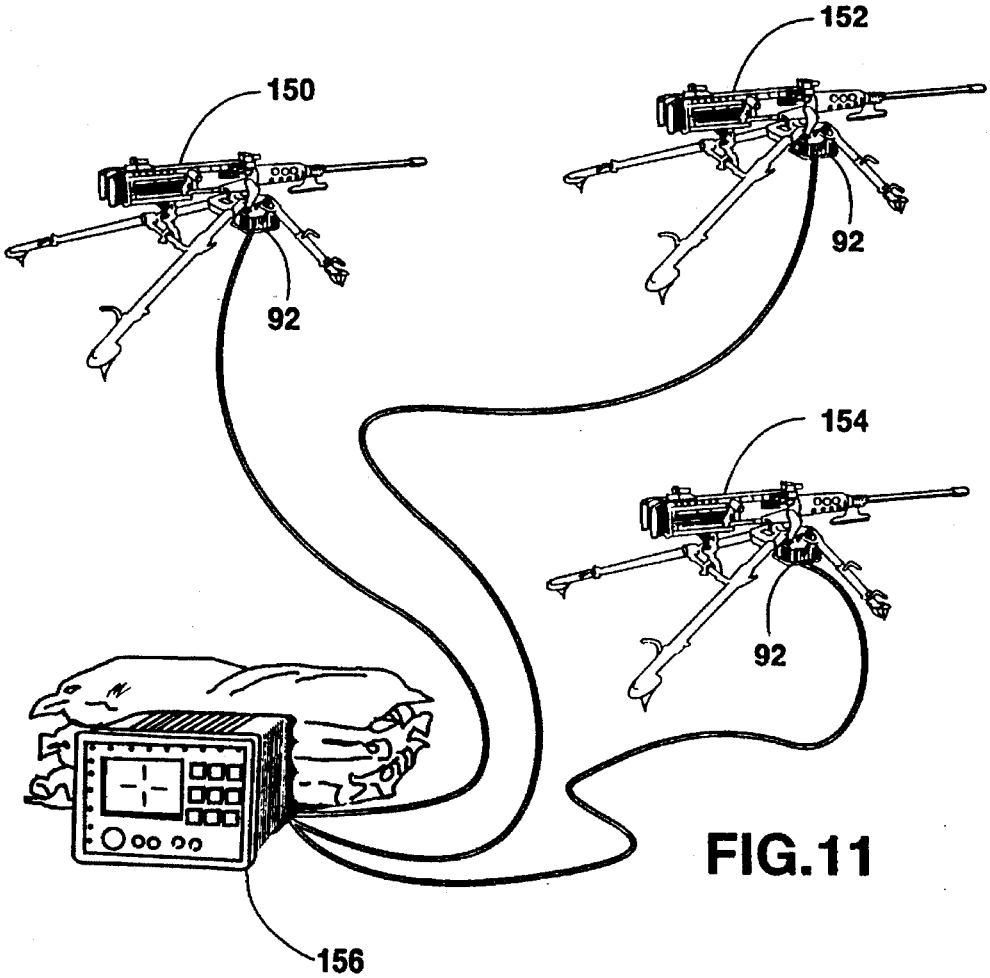
FIG. 11 illustrates coordination of the field-of-fire of several of the weapons by way of a central command post.

The aiming system of any of the embodiments described herein may include a data interface 92, as illustrated in FIG. 2, enabling communication of data between the aiming system and those of other similar weapons and/or a central command post. FIG. 11 illustrates, by way of example, three weapons 150, 152 and 154, each with such a modified aiming system including a data interface 92 coupling it to a central command post 156 and allowing transmission of azimuth and/or elevation readings between the respective aiming systems and the command post. Such an arrangement allows the fields of fire of the three weapons to be coordinated by the operator of the central command post. Additionally, other information could be transmitted for automatic display at the weapon. For example, information about an approaching target might be communicated to the gun crews, via their display devices, to assist in its identification.

Although they are shown coupled by cables, it will be appreciated that other kinds of data links could be employed to connect the weapons to the command post.

It will be appreciated that an advantage of embodiments of the invention, which comprise an aiming system having a display device attached to the machine gun, is that they can be used for surveillance. This applies whether the weapons are used individually or in groups connected to a central command post.

The data interfaces 92 could, advantageously be used to connect a recording device, for example a video recorder, so that the signal supplied to the display and other the information from the DSP and image sensor could be recorded for later analysis. This could be especially advantageous in view of the need to review actions by either the military or civil police officers, particularly for legal reasons.

What is claimed is:

1. A weapon unit comprising:

a support;

a gun mounted to the support by a mounting permitting pivotal movement of the gun relative to the support in at least one of azimuth and elevation;

angular position sensing means for detecting said pivotal movement and providing an angular position signal representing angular displacement of the gun relative to the support;

sensor means for providing a scene signal comprising a series of frames each representing a field of view of the sensor means, and a frame synchronization signal;

input means for inputting a signal other than the angular position signal;

display means for displaying an image of the field of view frame by frame;

artifact memory means for storing data corresponding to a said frame;

video generation means for generating, from the data stored in the artifact memory, a graphics artifact signal;

means for combining the scene signal and the graphics artifact signal and supplying the combined signals to the display means to superimpose the graphics artifact on the image of the scene displayed; and signal processor means for repeatedly writing into said memory data words each representing one of a plurality of pixels which, when displayed by said display means, form a graphics artifact, the signal processor means being responsive to the angular position signal, to the frame synchronization signal, and to the other signal to modify the stored data words to effect changes in the graphics artifact relative to the scene in direct dependence upon the angular displacement of the gun relative to the support, wherein each data word representing a graphics artifact pixel has a bit having a predetermined state different from that of other words in the memory, the video generation means detecting the state of such bit and controlling the combining means to substitute graphics artifact pixels for scene pixels in dependence upon said state.

2. A machine gun unit comprising a machine gun mounted to a support by a mounting permitting pivoting movement of the machine gun relative to the support in at least one of azimuth and elevation, position sensing means for providing position signals representing angular displacement of the machine gun relative to the support, and an aiming system comprising a sensor means for providing a scene signal representing a field of view for the aiming system, display means for displaying the field of view, input means, graphics artifact generation means, and signal processing means; the signal processing means being responsive to the position sensing means and the input means for controlling the graphics artifact generation means to combine the output of the graphics artifact generation means with the output of the sensor means for display by the display means, the signal processing means and graphics artifact generation means being operable to generate graphics artifacts delimiting a boundary of an area of the field of view, and the signal processing means is operable in response to limit signals input via said input means to record selected values of said position signals for either or both of azimuth and elevation to define said boundary and, subsequently, in dependence upon said position signals, to control said graphics artifact generation means to adjust the position of said delimiting graphics artifacts relative to the displayed field of view to reflect subsequent movement of the machine gun relative to the support.

3. A machine gun mounted upon a support means by means of a mounting permitting pivoting of the machine gun relative to the support means in at least one of azimuth and elevation;

position sensing means for providing position signals representing one or both of the azimuthal and elevational angular displacement of the weapon;

sensor means for providing a signal representing a field of view of the sensor means;

graphics artifact generation means for providing signals representing graphics artifacts comprising at least one mask delimiting an area of the field of view;

display means responsive to the sensor means and the graphics artifact generation means for displaying a combined image of the field of view and the graphics artifacts;

user-operable input means; and signal processing means operable initially in response to the user-operable input means and the position sensing means to store specific values of said position signal as boundaries of said area and subsequently to compare instant values of the position signal with said specific values and, in dependence upon such comparison, control the graphics artifact generation means to display with the displayed field of view at least a portion of a said mask.

* * * * *